TRAVELLER FOR RING SPINNING MACHINE

BACKGROUND OF THE INVENTION

The present invention relates to new and improved constructions of travellers for ring spinning machines, which travellers are of the type comprising a relatively long inner leg or limb and a shorter outer leg or limb bent at its end, there further being provided a guide or guiding portion which joins these legs or limbs.

Various constructions of travellers for frusto-conical spinning rings are known to the art from German Utility Model No. 7,814,259. The therein disclosed travellers have a yarn or thread guiding portion composed of two symmetrically arranged straight parts or portions which come together at an angle. With this design it is intended to eliminate the drawback of a too narrow passageway for the yarn or the like between the ring and the traveller, as such, for instance, is described in German Pat. No. 1,284,338.

A yarn or thread guide portion composed of straight parts does, indeed, provide a substantially larger cross-section of the yarn passageway between the ring and the traveller than a guide portion having a semi-circular configuration. However, because of this geometry of the guide portion which has a small radius, there is exactly defined the yarn or thread path. This, in turn, leads to rapid wear of the traveller at the apex radius located between the straight parts or portions.

Notwithstanding the large cross-section of the yarn passageway, it cannot be avoided that yarn thickenings and piecings will tend to jam at and run poorly through the apex radius. Furthermore, this shape of traveller tends to raise or turn-up individual fibers at the surface of the yarn or the like, which can lead to hairy yarns and to the formation of neps.

SUMMARY OF THE INVENTION

Therefore, with the foregoing in mind it is a primary object of the present invention to provide a new and improved construction of traveller for ring spinning machines which is not associated with the aforementioned drawbacks and limitations of the prior art.

Another and more specific object of the present invention is directed to the provision of a traveller having a sufficiently large yarn passageway and possessing good yarn running properties, without increasing the dimensions, and thus, the prevailing centrifugal forces, in relation to known travellers.

A further significant object of the present invention is directed to the provision of a new and improved construction of traveller having a relatively low friction throughpassage or passageway for thickenings and piecings of the yarn.

Now in order to implement these and still further objects of the invention, which will become more readily apparent as the description proceeds, the traveller of the present development is manifested by the features that the yarn or thread guide portion comprises a substantially quarter circular or arcuate segment part which joins the outer leg or limb of the traveller and leads to the apex of the yarn or thread guide portion, and a substantially straight part or section joining the apex and the inner leg or limb of the traveller.

According to a further feature of the invention, a radius is provided at the apex between the substantially quarter circular segment part and the substantially straight part or section.

A further feature of the invention contemplates that the radius at the apex is greater than 1 millimeter, the radius of the substantially quarter circular segment part is greater than 1.5 millimeters, and the radius between the substantially straight part or section and the inner leg or limb is greater than 1 millimeter.

Surprisingly, the drawbacks of the heretofore known travellers are eliminated by the proposed novel configuration of the yarn guide or guiding portion without impairing in any way the good running properties of the known travellers on the ring.

The straight section or part of the yarn guide portion ensures that there is available a large throughpass opening or passageway between the traveller and the ring, and the subsequent substantially quarter circle or quadrant circular segment part provides the undefined guide surface needed for the running of the yarn, and thus, the absence of local wear.

Furthermore, no individual fibers are raised by the large radius of the quarter circle segment part i.e. the part substantially defined by a quadrant of a circle, and piecings cannot jam. These characteristics tend to be particularly advantageous when working with very fine yarns with small ring and traveller.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
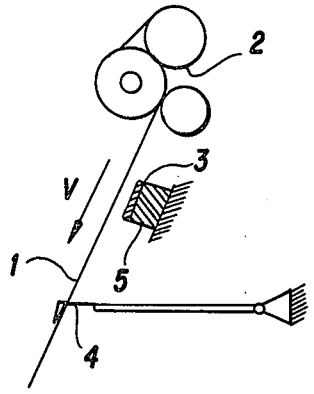
FIGS. 1 and 2 respectively show a cross-sectional view through a spinning ring equpped with conventional travellers.
Figure 2:
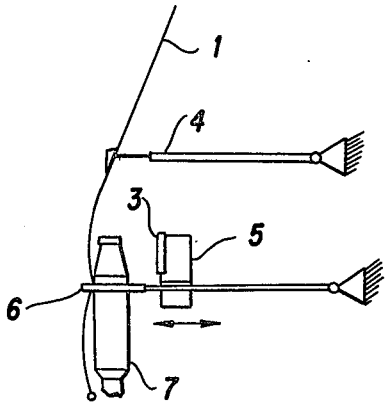

Describing now the drawings, it is to be understood that for purposes of simplifying the illustration thereof only enough of the construction of the ring spinning machine has been depicted in order to enable those skilled in the art to readily understand the underlying principles and concepts of the present development. Turning attention now to FIGS. 1 and 2, as an aid to comprehending the teachings of the present development there have been depicted therein travellers 1 and 2, respectively, of conventional design, these travellers 1 and 2 being illustrated in their operating position upon an associated ring 3 of a conventional ring spinning machine. Regarding the traveller 1 depicted in FIG. 1, it will be seen that such has a substantially semi-circular shaped yarn guide or guiding portion 4, and there is clearly visible in the showing of such FIG. 1 the narrow passageway or throughpassage for the yarn 5 between the traveller 1 and the upper edge of the ring 3. On the other hand, in FIG. 2 there is depicted the formation of the yarn guide or guiding portion of the traveller 2 from two symmetrical, substantially straight sections or parts 6 and 7 which are arranged at an angle with respect to one another, and this design obviously produces a substantial enlargement of the cross-sectional area of the passageway for the throughpassing yarn 5. However, this yarn 5 always run exactly at the apex region or apex 8 of the two straight parts or sections 6 and 7, resulting in the drawbacks previously indicated.

Figure 3:
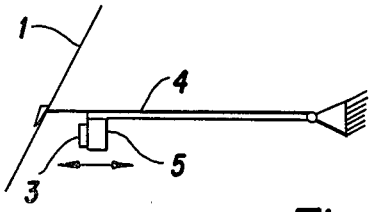
FIG. 3 is a cross-sectional view through a spinning ring equipped with a traveller constructed according to the present invention.
Figure 1:
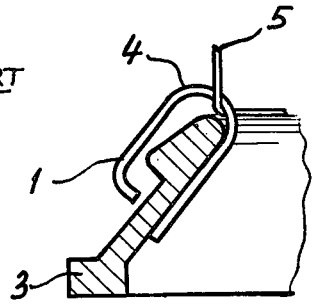
Fig 1 PRIOR ART
Figure 2:
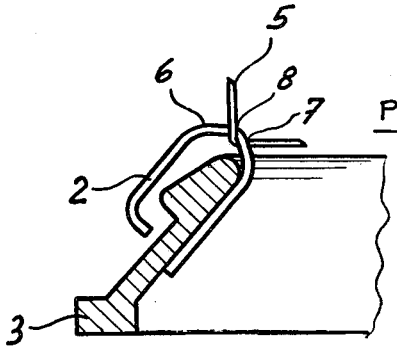
Figure 3:
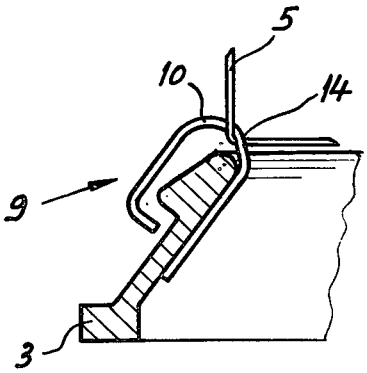
PRIOR ART Fig 3
Figure 4:
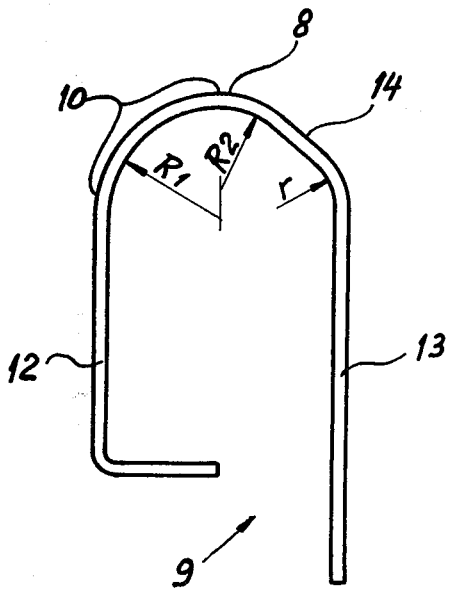
FIG. 4 illustrates a traveller of the type depicted in FIG. 3 on an enlarged scale.

On the other hand, in FIGS. 3 and 4 there is shown a construction of traveller 9 according to the present invention. Such traveller 9 will be seen to contain a yarn guide or guiding portion composed of a substantially quadrant circle part or quarter circular segment part 10 for the yarn throughpassage and which is located between the short leg or limb 12 and the apex 8 and a straight to slightly curved section or part 14 located between the apex 8 and the long leg or limb 13 of the traveller 9.

In the case of a yarn 5 containing thickenings or thickened portions, there is available a larger cross-section of the yarn passageway and, at the same time, at the adjacent bent part or quadrant 10 there is provided the desirable undefined free sliding surface. The radii of the traveller 9 advantageously have the following values:

$$R_1 \geqq 1.5 \text{ mm}, R_2 \geqq 1 \text{ mm}, r \geqq 1 \text{ mm}.$$

Figure 5:
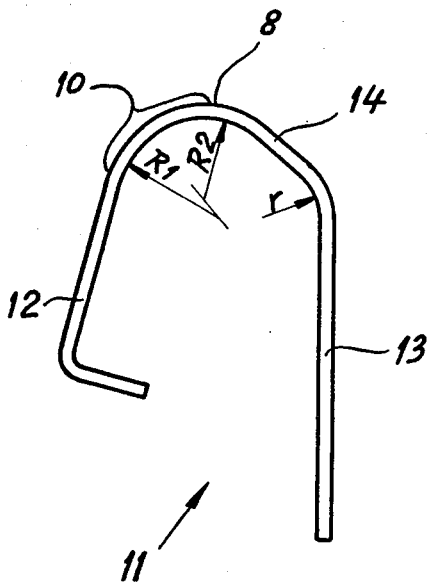
FIG. 5 illustrates a traveller of the type depicted in FIG. 4, but possessing a substantially V-shaped arrangement of the legs or limbs, especially useful for fine yarn counts with a correspondingly small ring profile and traveller.

The modified construction of traveller 11 depicted in FIG. 5 differs from the substantially U-shaped traveller 9 of FIGS. 3 and 4 in that, here, there are provided V-shaped widening legs or limbs 12 and 13, and furthermore, there are present different values for the radii which, preferably, are established as follows:

$$R_1 \geqq 1.5 \text{ mm}, R_2 \geqq 0.8 \text{ mm}, \text{ and } r \geqq 1 \text{ mm}.$$

Figure 6:
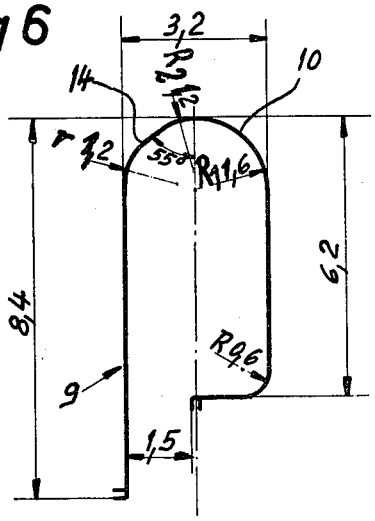
FIG. 6 illustrates a traveller with the actual dimensions.

Finally, FIG. 6 illustrates in detail the dimensions of a traveller 9 which is advantageously usable for the count range Tex 20. This traveller 9 corresponds in its dimensions to the ISO-Standard No. 2266, Series R20, No. 45, which is incorporated herein by reference and wherein the abbreviation or acronym "ISO" refers to the standards established by the International Standards Organization. According to section 3, of ISO 2266-1974(E), the number of a traveller is the nominal mass, in grams, of 1000 travellers of the same type and the term R20 indicates that the number is a preferred number in accordance with the R20 series of preferred numbers (ISO 3). There are clearly visible the two small radii r and $R_2$ which. here, each amount to 1.2 millimeters at the substantially straight section or part 14. The radius of $R_1$ of the bent or substantially quarter circular segment part or quadrant section 10 is substantially greater, amounting to 1.6 millimeters.

While there are shown and described present preferred embodiments of the invention, it is to be distinctly understood that the invention is not limited thereto, but may be otherwise variously embodied and practiced within the scope of the following claims. Accordingly,

What I claim is:

1. A traveller for a ring spinning machine comprising:

a long inner leg;

a shorter outer leg bent at an end thereof;

a yarn guide portion interconnecting the long inner leg and the short outer leg and having an apex portion;

said yarn guide portion comprising a substantially quarter circle segment part adjoining the short outer leg and leading to the apex portion of the yarn guide portion; and a straight section joining the apex portion and the long inner leg.

2. The traveller as defined in claim 1, wherein:

a radius is present at the apex portion between the substantially quarter circle segment part and the substantially straight section.

3. The traveller as defined in claim 2, wherein:

said radius at the apex portion is greater than 1 millimeter;

said substantially quarter circle segment part having a radius which is greater than 1.5 millimeters; and a radius between the substantially straight section and the long inner leg is greater than 1 millimeter.

4. The traveller as defined in claim 3, wherein:

the radius at the apex portion amounts to about 1.2 millimeters, the radius of the substantially quarter circle segment part amounts to about 1.6 millimeters, and the radius between the substantially straight section and the long inner leg amounts to about 1.2 millimeters.

5. The traveller as defined in claim 1, wherein:

the long inner leg and short outer leg are arranged in a substantially V-shaped configuration.

6. The traveller as defined in claim 5, wherein:

the apex portion has a radius greater than 0.8 millimeters, the substantially quarter circle segment part has a radius which is greater than 1.5 millimeters, and a radius between the substantially straight section and the long inner leg is greater than 1 millimeter.

* * * * *

UNITED STATES PATENT AND TRADEMARK OFFICE

CERTIFICATE OF CORRECTION

PATENT NO. : 4,481,764

DATED : November 13, 1984

INVENTOR(S) : ARTHUR WüRMLI

It is certified that error appears in the above-identified patent and that said Letters Patent is hereby corrected as shown below:

Column 2, line 35, delete "equpped" and replace it with --equipped--

Column 4, line 14, delete "shorter" and replace it with --short--

Signed and Sealed this

*Twenty-third* Day of *April 1985*

[SEAL]

*Attest:*

DONALD J. QUIGG

*Attesting Officer*

*Acting Commissioner of Patents and Trademarks*